United States Patent [19]

Yamada

[11] Patent Number: 5,014,095

[45] Date of Patent: May 7, 1991

[54] COLOR IMAGE FORMING APPARATUS

[75] Inventor: Takanobu Yamada, Osaka, Japan

[73] Assignee: Minolta Camera Co., Ltd., Osaka, Japan

[21] Appl. No.: 330,120

[22] Filed: Mar. 29, 1989

[30] Foreign Application Priority Data

Apr. 1, 1988 [JP] Japan ..... 63-81976

[51] Int. Cl.[5] ..... G03G 15/01

[52] U.S. Cl. ..... 355/327; 355/208; 355/245; 355/326

[58] Field of Search ..... 355/326, 327, 245

[56] References Cited

U.S. PATENT DOCUMENTS

| | | | |
|---|---|---|---|
| 4,018,522 | 4/1977 | Kasahara | 355/327 X |
| 4,063,724 | 12/1977 | Suda et al. | 271/277 |
| 4,593,991 | 6/1986 | Aoki et al. | 355/327 |
| 4,697,915 | 10/1987 | Hayashi et al. | 355/327 |
| 4,705,394 | 11/1987 | Watanabe | 355/245 |
| 4,710,016 | 12/1987 | Watanabe | 355/326 |
| 4,841,329 | 6/1989 | Kasamura et al. | 355/326 X |
| 4,841,336 | 6/1989 | Kusumoto et al. | 355/245 |
| 4,891,672 | 1/1990 | Takagi | 355/326 |
| 4,928,146 | 5/1990 | Yamada | 355/326 X |
| 4,937,624 | 6/1990 | Kohtani et al. | 355/326 X |
| 4,937,626 | 6/1990 | Kohtani et al. | 355/326 X |
| 4,939,548 | 7/1990 | Yamada | 355/326 X |
| 4,941,018 | 7/1990 | Kasamura et al. | 355/326 X |
| 4,958,191 | 9/1990 | Yamada et al. | 355/326 X |

FOREIGN PATENT DOCUMENTS

| | | |
|---|---|---|
| 57-204566 | 12/1982 | Japan . |
| 57-204567 | 12/1982 | Japan . |

*Primary Examiner*—A. T. Grimley
*Assistant Examiner*—Matthew S. Smith
*Attorney, Agent, or Firm*—Willian Brinks Olds Hofer Gilson & Lione

[57] ABSTRACT

Among four color developing units provided in a color image forming apparatus, a black developing unit which is arranged to be the last in order of development is disposed on either one of the farthest ends of a reciprocative movement holding member in the direction of its reciprocating movement, and the developing units arranged to be the first and the third in order of development are properly disposed on the second and the third stages of the reciprocative movement holding member. Each one of these developing units is freely moved to the developing location opposite to a photoconductor by reciprocating movement of the reciprocative movement holding member in accordance with a predetermined order of development.

6 Claims, 3 Drawing Sheets

Fig.4 (a)
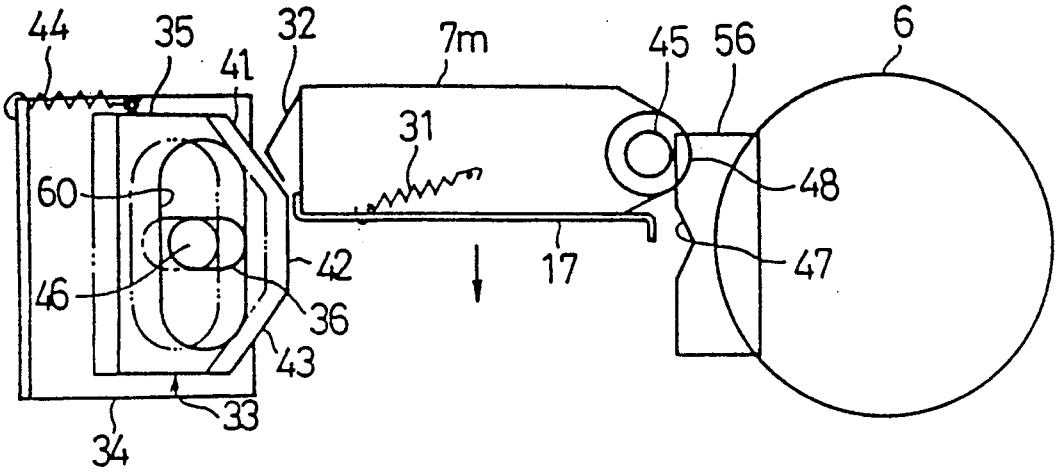
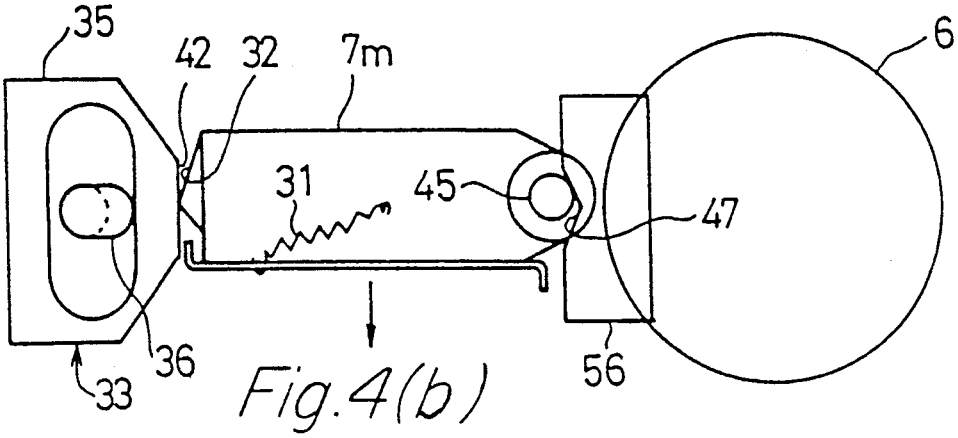
Fig.4(b)
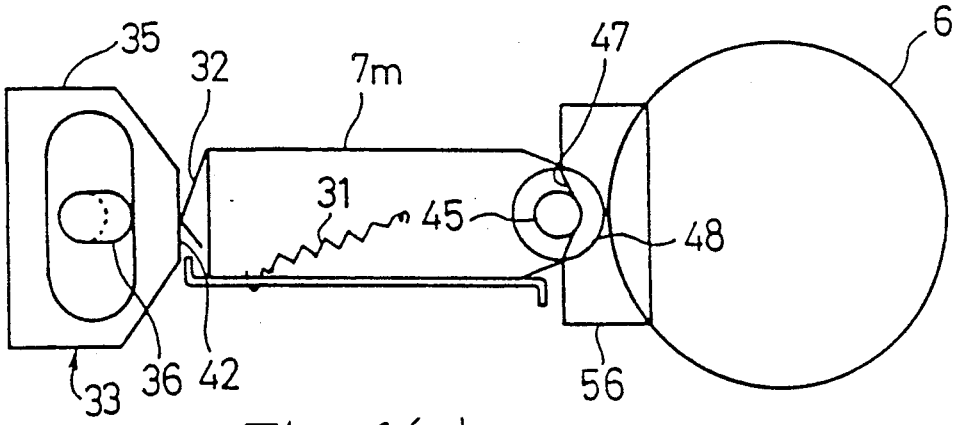
Fig.4(c)

COLOR IMAGE FORMING APPARATUS

BACKGROUND OF THE INVENTION

1. Technical Field of the Invention

The present invention relates to color image forming apparatus for forming colored images such as copying machines and printers.

2. Brief Description of Related Art

Generally, a color copying machine is provided for forming a colored image by using developers of four colors, and developing units accommodating each colored developer are arranged in the machine in one of the following three methods.

1. Stationary Method: Each developing unit is disposed at a predetermined position around a photoconductor (U.S. Pat. No. 4,063,724).

2. Rotary Method: Each developing unit is mounted on a rotary support member, and a desired developing unit is positioned at a developing location opposite to a photoconductor by rotating the rotary support member to a predetermined position.

3. Elevation Method: Each developing unit is mounted on an elevation support member, and a desired developing unit is positioned at a developing location opposite to a photoconductor by vertically moving the elevation support member to a predetermined position (Japanese Published Patent Application TOKKAI SHO 57-204567).

When a photoconductive drum is used as a photoconductor in the stationary method, the photoconductive drum should be provided with sufficient space on its circumference to have each developing unit always positioned facing the drum, and therefore, the diameter of the photoconductive drum inevitably becomes large. Besides, since the distance between the position where an electrostatic latent image is formed on the photoconductor and the developing location of each color are different, there occurs attenuation variation on the electrostatic latent image which has to be rectified.

The rotary method is able to solve the above-mentioned problems inherent in the stationary method. However, developer tends to easily fall out of developing unit since the rotary support member is rotated, and toner is only supplied to a developing unit which is positioned at a predetermined rotative position. Thus, the toner supply can not be made efficiently. It is also difficult for the rotary method to always operate a toner stirring means in the developing unit. In a device which is arranged to maintain each one of developing units supported by a rotaty support member at horizontal position, toner may not fall out of the developing unit even if the rotary support member is rotated, however, it causes to make the structure more complicated and invites an increase in manufacturing cost.

The elevation method has the disadvantageous point that it has to provide comparatively larger space in the vertical direction compared with the rotary method However, it is provided with characteristics which can solve all the problems inherent in the stationary method and the rotary method aforementioned.

In a color developing device which is provided with developing units of four colors, the order of priority of development for each color is decided. Generally, for instance, developing process is carried out in correlative relation with color mode in the order of priority of yellow (Y), magenta (M), cyan (C) and black (Bk) as shown in Table 1. The order of Bk is arranged to be always the last, however, the order of priority of development among Y, M and C may change according to the type of machine.

TABLE 1

| Color Mode | Order of Development 1st | 2nd | 3rd | 4th |
|---|---|---|---|---|
| 4 Colors | Y | M | C | Bk |
| 3 Colors | Y | M | C | — |
| Monocolor Red | Y | M | — | — |
| Monocolor Green | Y | C | — | — |
| Monocolor Blue | M | C | — | — |
| Monocolor Yellow | Y | — | — | — |
| Monocolor Magent | M | — | — | — |
| Monocolor Cyan | C | — | — | — |
| Monocolor Black | Bk | — | — | — |

The order of arrangement of developing units is also decided in the same order of priority of development. In the rotary method, each color developing unit is disposed on a regularly and reversely rotatable rotary support member along the direction of its circumference in order of Y, M, C and Bk, while in the elevation method, each color developing unit is disposed on a vertically movable elevation support member starting from the uppermost stage down to the lowermost stage (or from the lowermost stage to the uppermost stage) in order of Y, M, C and Bk.

In the case when multicolor copying operation is carried out under 4 colors mode, the rotary support member is only required to successively rotate one step each ($\frac{1}{4}$ rotation) in order of Y,M,C,Bk,Y,M, . . . in the case of the rotary method. On the other hand, in the case of the elevation method, a movement of three steps (3 stages) is required when the developing process is switched over from Bk to Y.

In such a conventional arrangement of developing units, two steps of jump (3 steps movement) is required for the elevation method thereby increasing the distance in movement. In the case of the rotary method, however, as is clear from Table 1, the maximum one step jump is only necessary, for instance, the switchover from Y to C as in monocolor green mode, and the switchover from C to Y as in three colors mode for multicolor copying.

As a means to cope with the extension of moving distance in the elevation method, it may be considered to move the elevation support member at high speed. However, such a high speed movement of the elevation support member can not be carried out for the reasons that the inertia of the elevation support member is large, and it is difficult to accurately position the support member at a predetermined height of developing location under such a high speed movement and it is necessary to raise the power of driving motor.

SUMMARY OF THE INVENTION

The main object of the present invention is to provide a color image forming apparatus in reciprocating method capable of advantageously forming colored images at high speed, wherein a reciprocating developing device is employed with specific consideration given to the arrangement of developing units so that the device can be provided with advantages inherent in the elevation method or more widely in the reciprocating method which is capable of switching over the developing units used for all color modes by the maximum one step jump equivalent to that of the rotary method.

Another object of the present invention is to provide a color image forming apparatus capable of switching over developing units used for all color modes by the maximum one step jump even if the order of priority of development is somewhat changed in using four color developing units, wherein the four color developing units are disposed on a movement support member in the direction of its reciprocating movement in such a manner that a black developing unit which is arranged to be the last in order of development is disposed on either one of the farthest ends of the movement support member with the developing units whose development are arranged to be done at the first and the third disposed on the second and third stages of the movement support member.

These and other objects and features of the present invention will become more apparent from the following description taken in conjunction with the accompanying drawings which illustrate specific embodiments of the invention.

DESCRIPTION OF THE DRAWINGS

FIGS. 4(*a*), 4(*b*) and 4(*c*) are side views showing the state how developing units are positioned at the developing location.

DESCRIPTION OF PREFERRED EMBODIMENT

Embodiments of the present invention will now be described below with reference to accompanying drawings.

Figure 1:
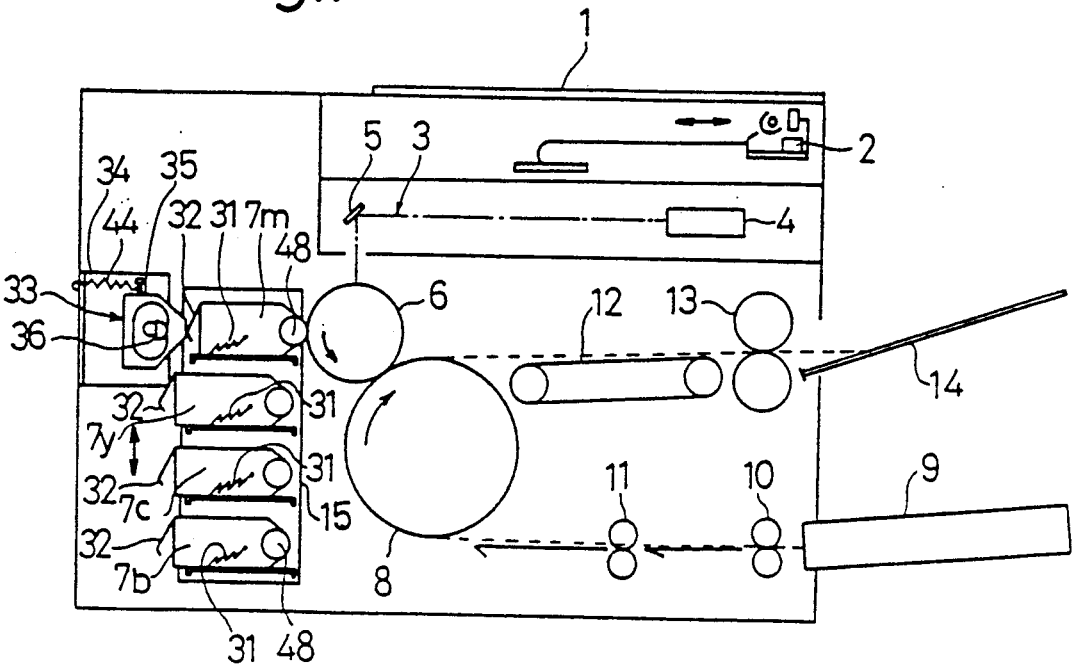
FIG. 1 is a side view in vertical section illustrating the whole schematic structure of an embodiment which is applied to a color copying machine.
Figure 3:
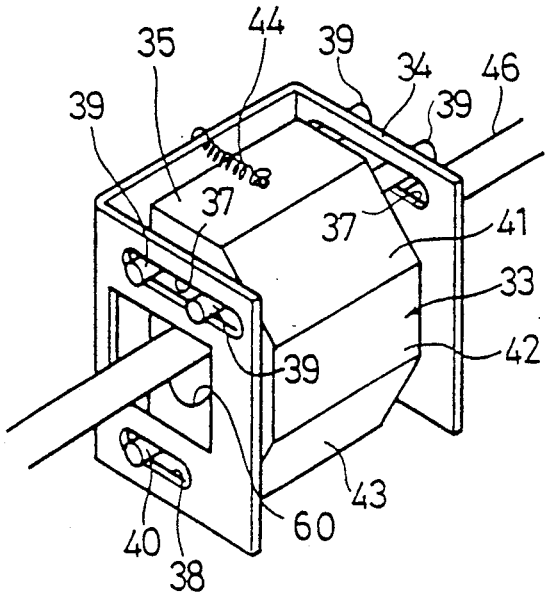
FIG. 3 is a perspective view of a guide means which functions with a developing unit at a developing location.

FIGS. 1 and 4 illustrate an embodiment of the present invention which is applied to a color copying machine wherein the order of priority of developing process is predetermined in order of yellow, magenta, cyan and black.

FIG. 1 shows the whole schematic structure of a copying machine. A color image of an original placed on a platen glass 1 is read as color signals of three primary colors by a CCD licenser 2. Each color signal is converted into four signals of Y (yellow), M (magenta), C (cyan) and Bk (black) by an image processing circuit and its output signal is transmitted to a laser optical system 3.

From a laser light generating device 4 in the laser optical system 3, laser light for forming images of each color corresponding to signals of the Y,M,C and Bk is irradiated. The laser light is then guided through a reflector 5 to a photoconductive drum 6 and irradiates the surface of the drum.

On the surface of the photoconductive drum 6 which rotates in the direction of the arrow in the figure, a latent image is formed by irradiation of the laser light. For the latent image formed corresponding to the signal Y, yellow toner Y is supplied to the photoconductive drum 6 from a developing unit *7y* and a yellow toner image is formed on the photoconductive drum 6. In the same manner, each colored toner is supplied to the photoconductive drum 6 from M developing unit *7m*, C developing unit *7c*, Bk developing unit *7b* thereby forming magenta toner image, cyan toner image and black toner image respectively for the latent image formed corresponding to the signal M, signal C and signal Bk.

A sheet of copy paper fed from a paper cassette 9 and transported by transport rollers 10,11 is wrapped around a transfer drum 8 which rotates in the direction of the arrow in the figure. Onto the paper wrapped around the transfer drum 8, each colored toner image on the photoconductive drum 6 is successively transferred by rotation of the transfer drum for the required number of times. The toner images of each color being transferred are composed on the copy paper and a colored toner image is formed thereon. The copy paper on which a colored toner image is formed is separated from the transfer drum 8 and is then transported through a transfer belt 12 to a fixing roller 13 where the colored toner image is fixed and then discharged to a discharge tray 14.

Figure 2:
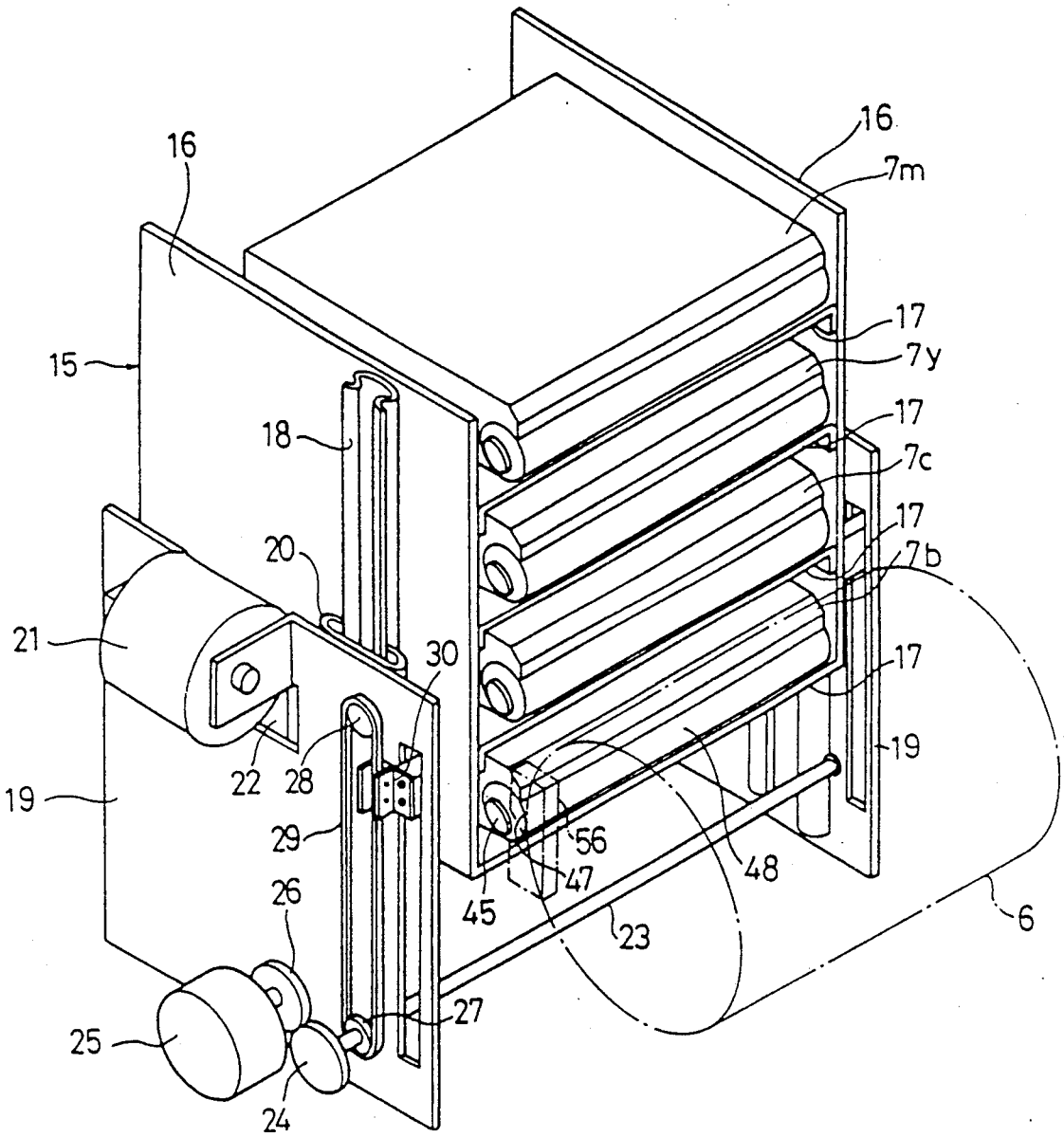
FIG. 2 is a perspective view showing an elevation method developing device in the copying machine of FIG. 1.

The M developing unit *7m*, Y developing unit *7y*, C developing unit *7c* and Bk developing unit *7b* are supported in this order by an elevation support member 15 starting from the uppermost to the lowermost of the support member in four stages. As shown in FIG. 2, the elevation support member 15 is provided with two sheets of sideboard 16,16 and four sheets of developing unit support board 17. On each one of the developing unit support boards 17, each developing unit *7m*, *7y*, *7c* and *7b* is placed, and they are movably held and guided back and forth.

On the outer surface of the sideboards 16,16 of the elevation support member 15, rails 18 are mounted in the vertical direction. The rails 18 are fitted into rails 20 attached to the inner surface of a pair of stationary boards 19,19 fixed on the main body of the machine. The elevation support member 15 is vertically movably guided and supported by the stationary boards 19.19 in a fitting relation between the rails 18.20. A balancer 21 of constant force spiral spring is mounted on the stationary board 19, and the tip portion of a spring sheet 22 of the balancer 21 is attached to the sideboard 16 of the elevation support member 15. The balancer 21 which is used balances with the total weight of the elevation support member 15, and it is also arranged to always maintain a balanced state irrespective of any vertical position of the eleveation support member 15. Although not shown in FIG. 2 the same balancer as mentioned above is mounted on the opposite stationary board 19.

A driving shaft 23 is hung at the lower portions between the stationary boards 19,19, and a gear 24 fixed to one end of the shaft is interlocked with a driving gear 26 of a DC motor 25. Adjacent to both ends of the driving shaft 23, sprockets 27 are fixed thereto. At the positions above the sprockets 27, there are provided sub-sprockets 28 held on the stationary boards 19, and chains 29 are wound around between the sprockets 27 and 28. The chain 29 and the elevation support member 15 are connected with couplers 30. Thus, the elevation support member 15 is moved to a predetermined height of position by rotative control of the DC motor 25 from either lower or upper position. Accordingly, the height of position of the elevation support member 15 can be freely set, for instance, to position the M developing unit *7m* at the height of developing location opposite to the photoconductive drum 6 or to position each developing unit *7y*, *7c*, *7b* at the height of developing location.

Each developing unit *7m*, *7y*, *7c* and *7b* is biased backward by a spring 31 provided on each of the developing unit support boards 17 on which each one of the developing units is placed, and they are positioned at a predetermined rear position, i.e. the position where a latent image on the photoconductive drum 6 is not affected even if it is positioned at the height of developing location. At the back end portions of the developing units 7m, 7y, 7c and 7b, flat springs 32 which are bended in v-shape are provided with their upper ends firmly fixed.

At the back of the elevation support member 15, a guide means 33 is arranged to advance a developing unit reached at the height of developing location to the operating position. The guide means 33 is, therefore, positioned behind a developing unit which is at the developing location, for instance, behind the M developing unit 7m in FIG. 1. The developing unit at the operating position is sufficiently most closely approached to the photoconductive drum 6 for the developer on a developing roll 48 to be supplied to the surface of the photoconductive drum 6.

The guide member 33 is provided with, as shown in FIGS. 1 and 4, a stationary frame 34 fixed on the main body of a copying machine, a moving cam 35 movably supported and guided back and forth by the stationary frame 34, and an eccentric driver 36 for moving the moving cam 35 back and forth. At the upper and lower portions of side boards of the stationary frame 34, there are formed guiding long grooves 37,38 in the horizontal direction, to which guide pins 39,40 protruded from side walls of the moving cam 35 are engaged. The moving cam 35 is thus guided and supported by the stationary frame 34.

The front of the moving cam 35 is successively formed by an inclined plane 41 at the upper portion, a vertical plane 42 at the middle portion and an inclined plane 43 at the lower portion. The moving cam 35 is provided with a hollow portion 60 bored through laterally wherein the eccentric driver 36 is positioned. The moving cam 35 is biased backward by a spring 44 energized between the stationary frame 34 and is moved back and forth with rotation of the eccentric driver 36 since the front wall of the hollow portion 60 is pressed to contact the driver 36. The eccentric driver 36 is firmly fixed to a cam driving shaft 46, and the cam driving shaft 46 is rotatively controlled by an unillustrated motor and clutch.

The upper inclined plane 41 of the moving cam 35 functions to forwardly guide any one of the developing units 7m, 7y, 7c and 7b which approaches the height of position for development to the photoconductive drum 6 gradually with the descent movement of the elevation support member 15.

The lower inclined plane 43 of the moving cam 35 functions to forwardly guide any one of the developing units 7m, 7y, 7c and 7b which approaches the height of position for development to the photoconductive drum 6 gradually with the ascent movement of the elevation support member 15.

The eccentric driver 36 functions to advance any one of the developing units 7m, 7y, 7c and 7b which reaches the height of position for development against the spring 44 and to return the developing unit to the rear position by energy of the spring 44.

The positioning of the developing units 7m, 7y, 7c and 7b at the forward position for development is carried out by an engagement of developing roll bearings 45 of the developing units 7m, 7y, 7c and 7b with the V groove 47 of a positioning plate 56 provided on both sides of thephotoconductive drum 6. When the forward position is thus decided, the developing roll 48 and the photoconductive drum 6 most closely approach each other to be ready for supplying toner to the portion of an electrostatic latent image on the photoconductive drum 6 from the developing units 7m, 7y, 7c and 7b.

The operation of a copying machine in a four color mode will now be described below.

With a start of copying operation, a latent image is formed on the photoconductive drum 6 corresponding to the Y signal, and at the same time, the Y developing unit 7y which is on the second stage of the elevation support member 15 is positioned at the developing location.

The latent image on the photoconductive drum 6 is then visualized into an yellow toner image by the yellow toner fed from the Y developing unit 7y. Thereafter, the yellow toner image is transferred onto a copy paper on the transfer drum 8 from the photoconductive drum 6. After finishing the development by yellow toner, next developing process by magenta toner is started.

At this time, the Y developing unit 7y on the second stage is switched over to M developing unit 7m on the uppermost stage which will be described referring to FIG. 4. When the developing process is proceeded to a development by magenta toner, a latent image corresponding to the M signal is formed on the photoconductive drum 6, and at the same time, the M developing unit 7m starts descending and advancing movement. In other words, the cam driving shaft 46 is rotated to advance the moving cam 35 as shown in FIG. 4 (a) (phantom line solid line). With this movement, the DC motor starts rotation and the elevation support member 15 starts descending and the M developing unit 7m also starts descending. With the descending movement of the M developing unit 7m, the flat spring 32 contacts the upper inclined plane 41 of the moving cam 35 positioned at the forward position. Then, the M developing unit 7m is guided to the diagonally lower front position by the upper inclined plane 41 through the flat spring 32. Accordingly, the M developing unit 7m gradually moves forward with its descending movement to reach the position illustrated in FIG. 4 (*b*). The flat spring 32 at this time elastically contacts the middle vertical plane 42 of the moving cam 35, and the developing roll bearing 45 is positioned inside the V groove 47 of the positioning plate 56.

While the M developing unit 7m further descends to reach the developing position shown in FIG. 4 (*c*), the M developing unit 7m still advances slightly by restitutive force of the flat spring 32. When it reaches the height of position for development, rotation of the DC motor 25 is stopped, and the developing roll bearing 45 engages with the V groove 47 in its center. Thus, the M developing unit 7m approaches the photoconductive drum 6 most closely for operation.

At the state wherein the M developing unit 7m is set at the operating location as in FIG. 4 (*c*), magenta toner is supplied to the photoconductive drum 6, and a latent image on the photoconductive drum 6 is visualized into a magenta toner image. Then, the magenta toner image is transferred onto a copy paper on the transfer drum 8 from the photoconductive drum 6.

After the development by magenta toner is finished, next developing process by cyan toner is started. At this time, the M developing unit 7m on the uppermost stage is switched over to C developing unit 7c on the 3rd stage. Accordingly, the elevation support member 15 is raised in such a manner that a developing unit jumps one stage (one step) for a switchover. In other words, when the developing process is proceeded to the development by cyan toner, the elevation support member 15 starts ascending movement, and the M developing unit 7*m* gradually moves backward from the location of operation, and then the moving cam 35 returns to a predetermined rear position by a half rotation of the eccentric driver 36. The moving cam 35 stays at the predetermined rear position until the Y developing unit 7*y* passes through upward with ascending movement of the elevation support member 15.

When the C developing unit 7*c* is approached, the moving cam 35 is again advanced to the forward position thereby gradually advancing the C developing unit 7*c* by the function of the lower inclined plane 43. The latent image formed corresponding to C signal on the photoconductive drum 6 is visualized into a cyan toner image by the C developing unit 7*c* positioned as shown in FIG. 4 (*c*), and the cyan toner image is transferred onto the copy paper.

The developing process by black toner is also carried out in almost the same manner, i.e. the C developing unit 7*c* on the third stage is switched over to the Bk developing unit 7*b* on the lowermost stage with ascending movement of the elevation support member 15. At the final stage of developing process, four colored toner images are transferred onto the copy paper superimposing one on top of the other, and colored copying by composite toner images of each color is accomplished.

When multi-colored copying is carried out, a development in order of Y,M,C and Bk is successively repeated, and it becomes necessary to firstly switchover from the Bk developing unit 7*b* to the Y developing unit 7*y*. This switchover can be performed by descending movement of the elevation support member 15 by two stages (one step jump), and two steps jump is not required.

The present invention may be structured in various modes besides the above embodiment. For instance, the first priority is given to the development by yellow toner in order of development in the embodiment, however, the present invention may be applied to the case when the development by magenta toner or cyan toner comes first in order of development.

In the above embodiment, the development by cyan toner comes third in the order of development, however, the development by yellow toner or magenta toner may be placed third under the present invention.

In the embodiment described above, a description is made of a color copying machine which vertically moves the developing units of four colors to a location of development by an elevation support member, however, the present invention is also applicable to a color copying machine which moves each developing unit to a location of development by reciprocative movement of an elevation support member in the horizontal direction.

As a whole, in a color image forming apparatus wherein the order of priority of development is set, and the development by black developing unit is set last in order of development, it may preferably be arranged to dispose a black developing unit on either one of the farthest stages of a moving support member with a first color developing unit and a third color developing unit in order of development placed on a second or a third stage of the moving support member. Practically, when the order of priority of development is decided in order of Y,M,C and Bk, the switchover of developing units can be performed by the maximum one step jump if each color developing unit is disposed in order of (1)-(4) as listed below.

(1) M, Y, C, Bk
(2) Bk, C, Y, M
(3) M, C, Y, Bk
(4) Bk, Y, C, M

Table 2 shows a relationship between all combinations in order of arrangement of four color developing units (No. 1-No. 24) and the maximum number of jumping steps in a color mode when a plurality of colored toners are used (the order of priority of development Y,M,C,Bk).

TABLE 2

| No. | Disposition Order of Developing Unit | Maximum Number of Jump of each color mode (4) | (3) | (R) | (G) | (B) | Conclusion |
|---|---|---|---|---|---|---|---|
| 1 | Y, M, C, Bk | 2 | 1 | 0 | 1 | 0 | 2 |
| 2 | Y, M, Bk, C | 1 | 2 | 0 | 2 | 1 | 2 |
| 3 | Y, C, M, Bk | 2 | 1 | 1 | 0 | 0 | 2 |
| 4 | Y, C, Bk, M | 2 | 2 | 2 | 0 | 1 | 2 |
| 5 | Y, Bk, M, C | 1 | 2 | 1 | 2 | 0 | 2 |
| 6 | Y, Bk, C, M | 2 | 2 | 2 | 1 | 0 | 2 |
| 7 | M, Y, C, Bk | 1 | 1 | 0 | 1 | 1 | 1 |
| 8 | M, Y, Bk, C | 2 | 2 | 0 | 1 | 2 | 2 |
| 9 | M, C, Y, Bk | 1 | 1 | 1 | 0 | 0 | 1 |
| 10 | M, C, Bk, Y | 2 | 2 | 2 | 1 | 0 | 2 |
| 11 | M, Bk, Y, C | 2 | 2 | 1 | 0 | 2 | 2 |
| 12 | M, Bk, C, Y | 2 | 2 | 2 | 0 | 1 | 2 |
| 13 | C, Y, M, Bk | 2 | 1 | 0 | 0 | 1 | 2 |
| 14 | C, Y, Bk, M | 2 | 2 | 1 | 0 | 2 | 2 |
| 15 | C, M, Y, Bk | 2 | 1 | 1 | 1 | 0 | 2 |
| 16 | C, M, Bk, Y | 1 | 2 | 1 | 2 | 0 | 2 |
| 17 | C, Bk, Y, M | 2 | 2 | 0 | 1 | 2 | 2 |
| 18 | C, Bk, M, Y | 1 | 2 | 0 | 2 | 1 | 2 |
| 19 | Bk, Y, M, C | 2 | 1 | 0 | 1 | 0 | 2 |
| 20 | Bk, Y, C, M | 1 | 1 | 1 | 0 | 0 | 1 |
| 21 | Bk, M, Y, C | 2 | 1 | 0 | 0 | 1 | 2 |
| 22 | Bk, M, C, Y | 2 | 1 | 1 | 0 | 0 | 2 |
| 23 | Bk, C, Y, M | 1 | 1 | 0 | 0 | 1 | 1 |
| 24 | Bk, C, M, Y | 2 | 1 | 0 | 1 | 0 | 2 |

, wherein
(4) Four Colors Mode
(3) Three Colors Mode
(R) Monocolor Red Mode
(G) Monocolor Green Mode
(B) Monocolor Blue Mode
(Conclusion) Maximum number of jumping steps.

As is clear from Table 2, the switchover of developing unit can be performed by the maximum one step jump as in the cases of No. 7, No. 9, No. 20 and No. 23 even in the reciprocative movement method.

Nos.1 and 24 show the conventional orders of arrangement which require the maximum two jumping steps for the reasons described above. In the other orders of arrangement, the maximum two jumping steps are also required except the above four cases.

Each colored toner image can be transferred onto a desired transfer material after it is transferred onto an intermediate transfer medium, and each toner image can be composed on an intermediatre transfer medium in this method.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A color image forming apparatus having developing units of four colors for developing an electrostatic latent image on an image holding member thereby making it into a toner image and capable of forming a colored image composed of each colored toner image, comprising:

a reciprocative movement holding member for holding each developing unit of four colors arranged in the direction of reciprocating movement;

a positioning means for positioning the reciprocative movement holding member at the position where each developing unit faces the image holding member from any direction in the direction of the reciprocating movement;

a control means for developing an electrostatic latent image corresponding to each color by using the developing units of four colors in a predetermined order of development wherein a black developing unit is arranged to function last in order of development; and an image composing means for composing each colored toner image prior to transferring the image onto a transfer material or when transfer is performed, wherein the black developing unit is disposed at either one of the farthest ends of the reciprocative movement holding member in the direction of its reciprocating movement, and the second developing unit in order of development is disposed at the other farthest end.

2. A color image forming apparatus as defined in claim 1, wherein the reciprocative movement holding member is movably disposed upwardly and downwardly in the vertical direction.

3. A color image forming apparatus as defined in claim 1, wherein said reciprocative movement holding member is balanced with a balancer which balances with a total weight thereof.

4. A color image forming apparatus as defined in claim 1, wherein said positioning means has a stationary frame fixed on a main body of said color image forming apparatus, a moving cam movably supported and guided back and forth by the stationary frame and a driver for moving the cam, and the moving cam has an inclined plane for moving a developing unit to said image holding member as the reciprocative movement of said reciprocative movement holding member.

5. A color image forming apparatus having developing units of four colors for developing an electrostatic latent image on an image holding member thereby making it into a toner image and capable of forming a colored image composed of each colored toner image, comprising:

a reciprocative movement holding member for holding four developing units (Y,M,C and Bk units) used for four colors of yellow, magenta, cyan and black arranged in four stairs in the direction of reciprocating movement;

a positioning means for positioning the reciprocative movement holding member at the position where each developing unit Y,M,C and Bk faces the image holding member from any direction in the direction of the reciprocating movement;

a control means for developing an electrostatic latent image corresponding to each color by using the developing units Y,M,C and Bk of four colors in a predetermined order (an order of Y,M,C and Bk); and an image composing means for composing each colored toner image of yellow, magenta, cyan and black prior to transferring the image onto a transfer material or when transfer is performed, wherein each developing unit Y,M,C and Bk is held by the reciprocative movement holding member in order of (M,Y,C, Bk) or (Bk,C,Y,M) or (M,C,Y,Bk) or (Bk,Y,C,M) against the direction of reciprocating movement of the reciprocative movement holding member.

6. A color image forming apparatus as defined in claim 5, wherein the reciprocative movement holding member is movably disposed upwardly and downwardly in the vertical direction.

* * * * *

UNITED STATES PATENT AND TRADEMARK OFFICE

CERTIFICATE OF CORRECTION

PATENT NO. : 5,014,095

DATED : May 7, 1991

INVENTOR(S) : Takanobu Yamada

It is certified that error appears in the above-identified patent and that said Letters Patent is hereby corrected as shown below:

In col. 1, line 58, after "method" insert --.-- (period).

In col. 2, in TABLE 1, line 7 of the Table, change "Magent" to --Magenta--.

In col. 5, line 17, delete "most".

In col. 6, line 1, change "thephotoconductive" to --the photoconductive--.

In col. 6. line 16, change "an" to --a--.

Signed and Sealed this

Twenty-second Day of September, 1992

*Attest:*

DOUGLAS B. COMER

*Attesting Officer*

*Acting Commissioner of Patents and Trademarks*